United States Patent [19]

Pringle

[11] Patent Number: 4,524,831

[45] Date of Patent: Jun. 25, 1985

[54] HYDRAULIC CONTROLLED WELL VALVE

[75] Inventor: Ronald E. Pringle, Houston, Tex.

[73] Assignee: Camco, Incorporated, Houston, Tex.

[21] Appl. No.: 565,506

[22] Filed: Dec. 27, 1983

[51] Int. Cl.[3] ..... E21B 34/10

[52] U.S. Cl. ..... 166/322; 166/117.5

[58] Field of Search ..... 166/322, 321, 319, 373, 166/374, 375, 117.5, 332, 320, 264, 72

[56] References Cited

U.S. PATENT DOCUMENTS

| | | | |
|---|---|---|---|
| 3,156,300 | 11/1964 | Page et al. | 166/72 |
| 3,216,501 | 11/1965 | Page, Jr. | 166/72 |
| 4,066,128 | 1/1978 | Davis et al. | 166/117.5 X |
| 4,437,514 | 3/1984 | Canalizo | 166/72 |
| 4,462,465 | 7/1984 | Strickland | 166/332 X |

FOREIGN PATENT DOCUMENTS

| | | |
|---|---|---|
| 1165920 | 10/1969 | United Kingdom . |
| 2121090 | 12/1983 | United Kingdom . |

*Primary Examiner*—Stephen J. Novosad
*Assistant Examiner*—Thuy M. Bui
*Attorney, Agent, or Firm*—Fulbright & Jaworski

[57] ABSTRACT

A hydraulic controlled valve for use in a well conduit for controlling fluid flow between the inside and outside of the conduit. A sliding valve is hydraulically controlled by a piston from the well surface in which the piston is also in communication with the outside of the body for hydrostatically compensating the piston. A tubular member is positioned inside of the sliding sleeve and has an opening with seals affixed to the tubular member about the tubular member opening and against the valve element whereby the valve is uninfluenced by pressure inside of the conduit. The valve may be retrievable and can be positioned in a mandrel pocket or a tubing nipple. The valve may seal against the internal diameter of the well conduit eliminating a tubular wall for providing maximum flow area capabilities.

10 Claims, 5 Drawing Figures

HYDRAULIC CONTROLLED WELL VALVE

BACKGROUND OF THE INVENTION

The present invention is directed to a hydraulic controlled well valve for use in a well conduit controlling fluid flow between the inside of the conduit and the outside of the conduit such as the well annulus. The valve is operated by a single hydraulic control line to the well surface. The piston is subjected to differential pressure between the control line pressure and the annulus fluid whereby the valve does not have to overcome hydrostatic head forces for closure and therefore is not limited in its setting depths. In addition, the seals to the bore are equal whereby the valve will not be influenced by bore or tubing pressure. The valve is a sliding valve type which achieves maximum flow area by utilizing one side of the sealing area against the well conduit thereby eliminating one tubular wall for increasing flow area capabilities. The valve may be wireline retrievable and be set in a sidepocket mandrel or in a nipple in the well tubing.

SUMMARY

The present invention is directed to a hydraulically controlled valve for use in a well conduit for controlling fluid flow between the inside and the outside of the conduit. A tubular body is adapted to be connected in a well conduit and the body includes an opening for providing communication between the inside and the outside of the conduit. A valve is positioned to open and close the opening and is controlled by a piston which is exposed on one side to a hydraulic control means adapted to extend to the well surface for controlling the movement of the piston. A second side of the piston is in communication with the outside of the body whereby the valve may be hydrostatically compensated when used in a well.

Still a further object to the present invention is wherein the valve element is a sliding tube positioned inside of the body and including biasing means acting against the tube in a direction to close the body opening.

Still a further object of the present invention is the provision of an inner tubular member positioned inside of the sliding tube and having an opening therethrough and seal means are affixed to the inner member about the member opening sealing against the sliding tube.

Preferably, the tubular body opening and the tubular member opening are aligned and the sliding tubular valve does not seal against the tubular body but allows fluid outside of the body to be in communication with the piston through the body opening.

A still further object of the present invention is wherein the body includes a side pocket mandrel and the valve is retrievable.

Yet a still further object is the provision of a retrievable valve for use in a well conduit having a hydraulic control line extending to the well surface and having an opening therein. The valve controls fluid flow between the inside and outside of the conduit. The valve includes an inner tubular member having upper and lower seal means adapted to engage and seal against the inside of the well conduit and includes an opening therethrough. A sliding tubular valve element having an opening is positioned outside of the tubular member and longitudinally moves the valve opening between open and closed positions relative to the body opening without sealing against the body. Seal means are affixed to the inner tubular member and about the tubular member opening and seals against the valve element. Piston means connected to the valve element are adapted to be in communication on one side with the hydraulic line when the valve is inserted into the well conduit and the piston is adapted to be in communication on the second side with the outside of the well conduit through the well conduit opening when the valve is inserted into the well conduit for hydrostatically compensating the piston. Preferably, the piston means is sealably engaged between the inside of the well conduit and the inner tubular member thereby avoiding an outer wall to allow greater flow capacity in the valve. In addition, the seal means between the valve element and the inner conduit are preferably metal.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present valve will be described in connection with its application as a wireline retrievable circulating kill valve for use in a sidepocket mandrel, for purposes of illustration only, it will be understood that the present invention may be used in other applications and in other types of well conduits.

Figure 1:
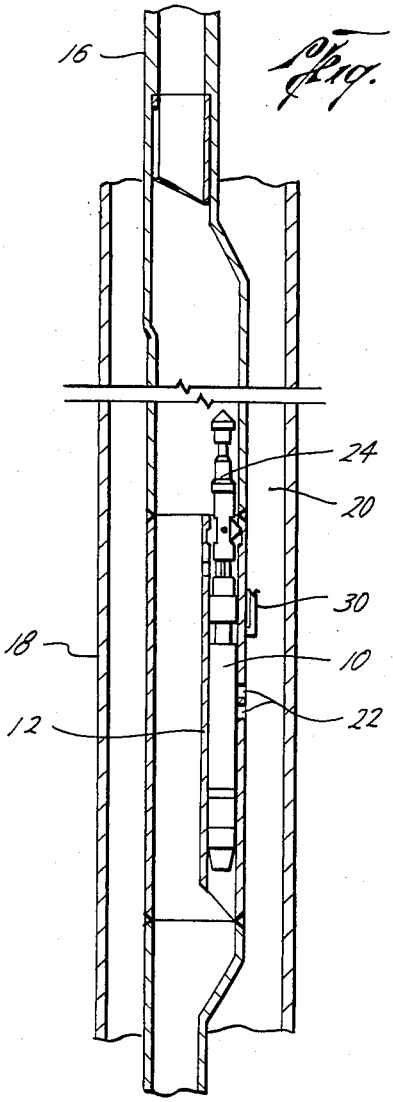
FIG. 1 is an elevational view, in cross section, of the use of the present invention in a sidepocket mandrel in a well casing.

Referring now to the drawings, and particularly to FIG. 1, the reference numeral 10 indicates the hydraulic control valve of the present invention positioned in any suitable well conduit such as a well nipple, or as shown, in one or more sidepockets 12 of a mandrel 14. The mandrel 14 is adapted to be connected in any well conduit such as the well tubing 16 which is positioned in a casing 18 having an annulus 20 therebetween in a well.

Figure 2A:
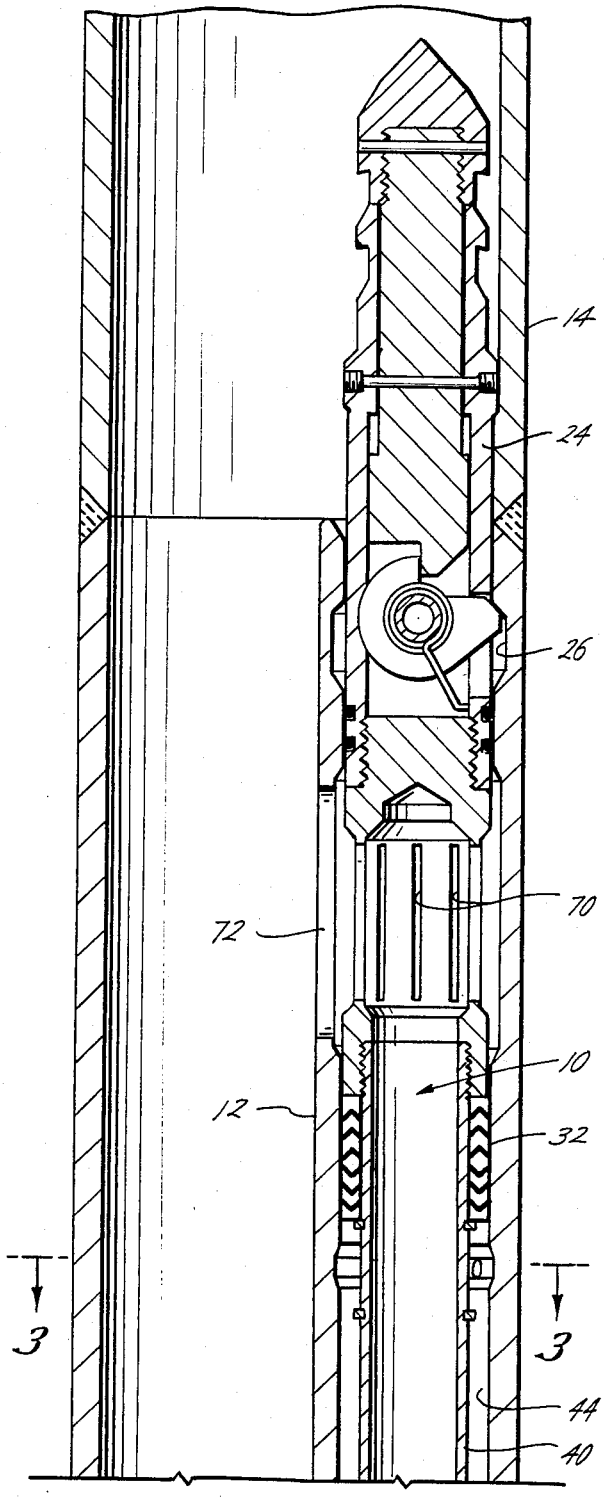
FIGS. 2A and 2B are continuations of each other and are enlarged cross sections of the valve shown in FIG. 1, shown in the open position, and are cross sections taken along the line 2A,B—2A,B of FIG. 3.
Figure 2B:
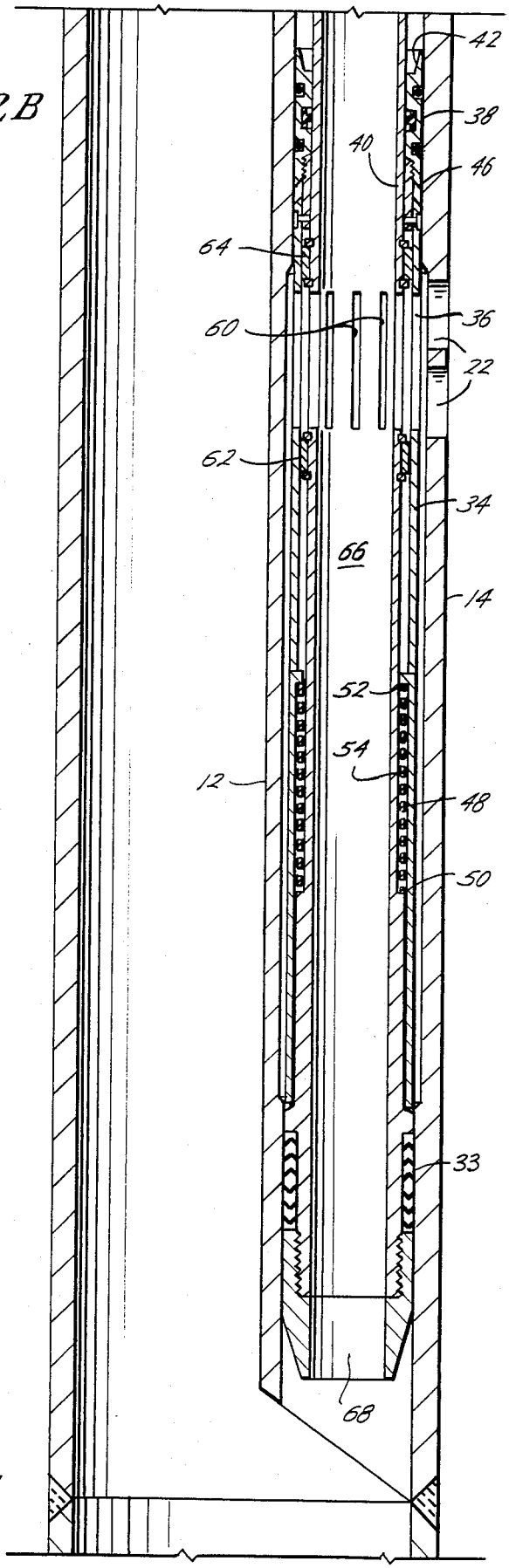

Referring now to FIGS. 1, 2A and 2B, the well conduit or mandrel 14 includes one or more openings 22 for providing fluid communication between the inside and outside of the mandrel 14. The valve 10 is secured in the well conduit or mandrel 14 by any suitable means such as a conventional well lock 24 such as a Camco type R well lock which locks in notches 26 to position the valve 10 adjacent the opening 22. The well conduit or mandrel 14 also includes a hydraulic control line generally indicated by the reference numeral 30 connected to the port 28 for providing hydraulic control fluid from the well surface to the valve 10 for controlling the valve 10.

The valve 10 includes an upper seal 32 and a lower seal 33 for sealing against the inside of a sidepocket 12 of the mandrel 14. A sliding tubular sleeve valve element 34 having one or more openings 36 is positioned inside the sidepocket 12 and is longitudinally movable for moving the position of the valve opening 36 relative to the mandrel openings 22. A piston 38 is connected to the valve 34. The piston 38 is slidably and sealably movable against the inside wall of the sidepocket 12 of the mandrel 14 on one side and also against inner tubular member 40. The piston is exposed on a first side or top 42 to a passageway 44 which is in fluid communication with the hydraulic port 28 and hydraulic line 30 leading to the well surface whereby hydraulic fluid can be applied to the piston 40 to move the sliding valve 34 downwardly to bring the valve opening 36 into alignment with the mandrel opening 22. It is to be noted that the second side or bottom 46 of the piston 38 is exposed and in communication with the fluid in the annulus 20 on the outside of the mandrel 14 through the openings 22. That is, the valve element 34 while telescopically movable against the inside of the sidepocket 12 of the mandrel 14 does not sealably engage the inside of the mandrel 14. Therefore, fluid from the outside of the mandrel 14 may enter the openings 22 around the outside of the valve element 34, and apply hydrostatic pressure to the bottom 46 of the piston 38. This is advantageous as the hydrostatic pressure in the control line 30 acting on the top 42 of the piston 38 is substantially equal to the hydrostatic pressure on the outside of the mandrel 14 acting on the bottom 46 of the piston 38. This allows the valve 10 to be set at greater setting depths in a well as it does not have to overcome the hydrostatic head forces in the control line 30 when it is desired to close the valve. That is, the valve 34 is moved to an open position by pressuring up the hydraulic control fluid in the line 30 from the surface. When it is desired to close the valve 34, the pressure in the line 30 is relieved, is hydrostatically balanced, and a suitable biasing means is provided to act against the valve 34 to move it to a closed position. Thus, a spring 48 may be provided acting against a shoulder 50 on the inner tubular member 40 and a shoulder 52 on biasing element 54 which in turn acts against the bottom of the valve 34. However, in the case where the fluid in annulus 20 is heavier than the control fluid in line 30, the annulus fluid will provide a closing force, and, if sufficient, the spring 48 may be omitted.

The inner tubular member 40 includes one or more openings 60 which are positioned to be located in registry with the mandrel openings 22 when the valve 10 is positioned in the sidepocket 12. Metal seals 62 and 64 are provided fixedly connected to the inner tubular member 40 and about the openings 60 and seal between the inner tubular member 40 and the sliding sleeve valve element 34. Thus, the valve element 34 is sealed against the interior 66 of the valve 10, but is not sealed against the openings 22 in the mandrel 14. It is to be noted that the pressure against the seals 62 and 64 by the well pressure is balanced. Preferably, the seals 62 and 64 are metal seals to provide a metal-to-metal seal between the tubing bore 66 and the annulus 20.

It is further to be noted that the valve 10 is constructed so as the piston 38 seals against the internal diameter of the mandrel pocket 12 thereby eliminating one tubular wall for providing a circulating kill valve with maximum flow area capabilities. The fluid flowing into the bore 66 of the valve 10 can flow out the bottom 68 and/or out of the top opening 70 through wall opening 72 in the pocket 12 as generally the valve lock 24 prevents fluid flow through the locks. Thus, in the present application, as a circulating kill valve, the present valve 10 achieves maximum flow area in a valve that is wireline retrievable. The valve 10 is insertable into and retrievable from the sidepocket 12 of the mandrel 14 as is conventional, such as generally described in U.S. Pat. No. 3,874,445.

Figure 4:
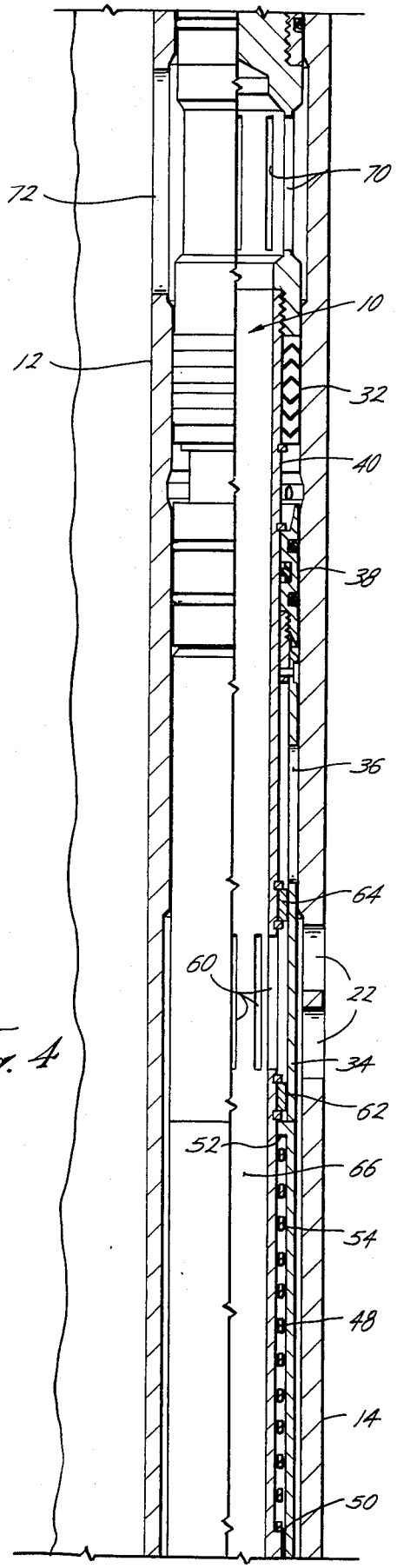
FIG. 4 is a fragmentary elevational view, in cross section, of the valve of the present invention shown in the closed position.
Figure 3:
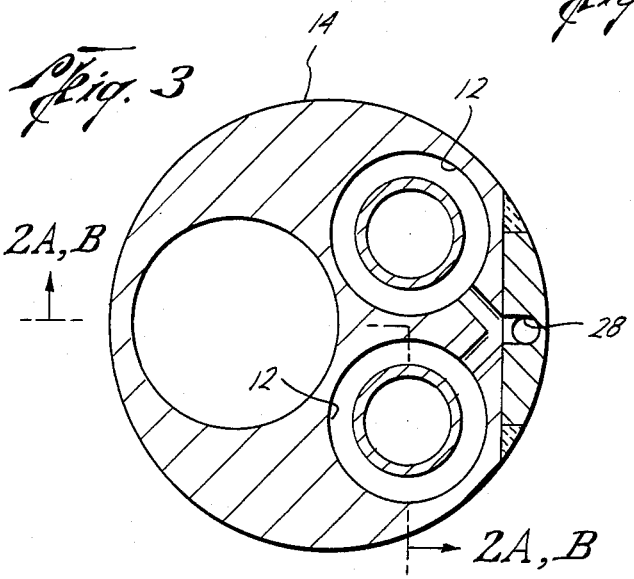
FIG. 3 is a cross-sectional view taken along the line 3—3 of FIG. 2A.

In use, the spring 48 and/or the annulus fluid in annulus 20 acts to normal bias the piston 38 and the valve 34 to the close position, as best seen in FIG. 4. When it is desired to open the valve 34, hydraulic fluid at the surface is applied to the line 30 and against the top of the piston 38 to move the piston 38 downwardly overcoming the hydrostatic pressure in the annulus 20 and the spring 48 to move valve 34 to the open position, as best seen in FIGS. 2A and 2B to bottom out on element 54.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A hydraulic controlled valve for use in a well conduit for controlling fluid flow between the inside and outside of the conduit comprising, a tubular body adapted to be connected in a well conduit, said body having an opening for providing communication between the inside and outside of the body, a sliding tubular valve element having an opening and positioned inside of the body for longitudinally moving the valve opening between open and closed positions relative to said body opening, a tubular conduit having an opening and positioned inside of said valve element, said tubular conduit having an inside in communication with the inside of the tubular body, seal means between the conduit and said valve element about the conduit opening, piston means sealably movable between the body and the tubular conduit and connected to the valve element for moving said valve element, hydraulic control means connected to the body and in communication with one side of the piston, said control means adapted to extend to the well surface for controlling the movement of the piston, and said piston having a second side in communication with the outside of the body through the body opening for hydrostatically compensating the piston.

2. The apparatus of claim 1 wherein said seal means are fixed to the tubular conduit.

3. The apparatus of claim 1 wherein the body includes a side pocket mandrel.

4. The apparatus of claim 1 wherein the tubular body opening and said tubular conduit opening are aligned.

5. The apparatus of claim 1 wherein sliding tubular valve does not seal against the tubular body.

6. The apparatus of claim 1 wherein the inside of the tubular conduit is in communication with the tubular body at both ends of the tubular conduit for providing increased communication of fluid between the inside and outside of the tubular body.

7. A hydraulic controlled valve for use in a well conduit having a hydraulic control line extending to the well surface and having an opening therein for controlling fluid flow between the inside and the outside of the conduit comprising, an inner tubular conduit having upper and lower seal means adapted to engage and seal against the inside of the well conduit and having an opening therethrough, the inside of the tubular conduit being in communication with the inside of the well conduit when inserted into the well conduit, a sliding tubular valve element having an opening and positioned outside of the tubular conduit and longitudinally moving the valve opening between open and closed positions relative to said body opening, second seal means between the valve element and the inner tubular conduit, piston means connected to the valve element, said piston means adapted to be on one side in communication with the hydraulic control line when the valve is inserted in the well conduit for opening the valve, and said piston adapted to be in communication on a second side with the outside of the well conduit through the well conduit opening when the valve is inserted into the well conduit for hydrostatically balancing the piston, and biasing means acting against the valve element in a direction to close said valve.

8. The apparatus of claim 7 wherein the valve is retrievable, and said piston means sealably engages the inside of the well conduit and said inner tubular conduit.

9. The invention of claim 7 wherein the second seal means is affixed to the inner tubular conduit and are metal.

10. The apparatus of claim 7 wherein the inside of the tubular conduit is in communication with the inside of the well conduit at both ends of the tubular conduit for increasing the fluid flow between the inside and outside of the well conduit.

* * * * *